US007793670B2

(12) United States Patent
Lee

(10) Patent No.: US 7,793,670 B2
(45) Date of Patent: Sep. 14, 2010

(54) FIXTURE FOR OPTICAL ELEMENTS FOR USE IN CLEANING PROCESSES

(75) Inventor: Hsin-Ho Lee, Tu-Cheng (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 1176 days.

(21) Appl. No.: 11/411,518

(22) Filed: Apr. 26, 2006

(65) Prior Publication Data

US 2007/0006902 A1 Jan. 11, 2007

(30) Foreign Application Priority Data

Jul. 8, 2005 (CN) ..... 2005 1 0035927

(51) Int. Cl.
*B08B 3/00* (2006.01)
*B08B 7/00* (2006.01)

(52) U.S. Cl. ..... 134/136; 134/84; 134/25.1; 134/25.4

(58) Field of Classification Search ..... 134/21, 134/25.1, 25.4, 901, 32, 95.2, 104.2, 84, 134/85, 136, 137
See application file for complete search history.

(56) References Cited

U.S. PATENT DOCUMENTS 6,281,468 B1 * 8/2001 Souel et al. ..... 219/121.11
2004/0074525 A1 * 4/2004 Widman et al. ..... 134/34
2005/0045589 A1 * 3/2005 Rastogi et al. ..... 216/67

FOREIGN PATENT DOCUMENTS

JP 2000-197859 A 7/2000

* cited by examiner

*Primary Examiner*—Alexander Markoff
(74) *Attorney, Agent, or Firm*—Jeffrey T. Knapp

(57) ABSTRACT

A fixture for optical elements includes a washing bar, a holder and a vacuum pump. The washing bar includes an inner channel and a connecting portion in communication with the inner channel. A hole is formed in the washing bar for communicating with the inner channel. The holder connects with the washing bar. The holder has a holding surface communicating with the hole. The holding surface has a shape corresponding to a peripheral surface of the optical elements to be held. The vacuum pump is connected with the connecting portion. The vacuum pump is configured for vacuum the washing bar so as to effectively suck the one of the optical elements on the holding surface. The present fixture can hold optical elements firmly and does not damage the optical elements.

8 Claims, 5 Drawing Sheets

FIXTURE FOR OPTICAL ELEMENTS FOR USE IN CLEANING PROCESSES

BACKGROUND OF THE INVENTION

1. Field of the Invention

The present invention generally relates to fixtures for optical elements and, more particularly, to a fixture for optical elements for use in cleaning processes, such as lenses.

2. Discussion of the Related Art

Nowadays, optical elements such as lenses are commonly used in digital cameras or digital video recorders. There is more and more demand for higher quality and serviceability of these optical elements. A film such as an antireflective film or an infra-red cut film is generally deposited on the optical elements, especially on lenses. To improve imaging quality, it is important to wash the optical elements before depositing a film thereon. Therefore it can be seen that developing optical cleaning technologies effectively before depositing film is an important area of research.

A conventional method for washing optical elements generally includes following steps: fixing optical elements to be washed on a washing apparatus; placing optical elements fixed on the washing apparatus in liquid to clean; and taking the washing apparatus with optical elements out of liquid and then removing the optical elements. A typical washing apparatus 30 for optical elements is shown in FIG. 5. The washing apparatus 30 includes a holding frame 31 and a plurality of clamping poles 32. The holding frame 31 includes a top board 33 and a bottom board 34, and each of the top board 33 and bottom board 34 have a plurality of guarding slots 35 formed therein. The clamping poles 32 extend through the guarding slots 35, and can be moved along at least one of the guarding slots 35. The clamping poles 32 can also be connected with the holding frame 31. Each clamping pole 32 has a plurality of V-shaped grooves 36. In use, the V-shaped grooves 36 of clamping poles 32 can hold a plurality of optical elements between the clamping poles 32.

However, in the method of washing optical elements using the washing apparatus 30, if the optical elements can not be fixed firmly enough, the optical elements held on the washing apparatus 30 may become separated from the washing apparatus 30, and float on the liquid surface or adhere together. As a result, the optical elements can not be washed effectively. In addition, if the optical elements are fixed too firmly, the clamping poles 32 may damage the optical elements. Therefore, it is difficult to fix the optical elements properly. There are also some optical elements that are too small to be fixed easily on the washing apparatus 30.

What is needed, therefore, is a fixture for optical elements for use in cleaning process, which can hold optical elements firmly and does not damage the optical elements.

SUMMARY OF THE INVENTION

In one aspect, a washing apparatus for optical elements includes a washing bar, a holder and a vacuum pump. The washing bar includes an inner channel and a connecting portion in communication with the inner channel. A hole is formed in the washing bar for communicating with the inner channel. The holder connects with the washing bar. The holder has a holding surface communicating with the hole. The holding surface has a shape corresponding to a peripheral surface of the optical elements to be held. The vacuum pump is connected with the connecting portion. The vacuum pump is configured to create a vacuum in the washing bar so as to effectively hold the optical elements on the holding surface.

In another aspect, a method of cleaning an optical element, comprising the steps of: creating suction in an inner channel of a washing bar, the washing bar being connected with a holder, the holder having a holding surface in communication with the inner channel; holding the optical element on the holding surface by suction; immersing the washing bar with the optical element into a clean liquid for cleaning; taking out the washing bar and the optical element after cleaning is finished; and cutting off the suction to release the optical element.

Other advantages and novel features will become more apparent from the following detailed description when taken in conjunction with the accompanying drawings.

BRIEF DESCRIPTION OF THE DRAWINGS

Many aspects of the fixture can be better understood with reference to the following drawings. The components in the drawings are not necessarily drawn to scale, the emphasis instead being placed upon clearly illustrating the principles of the present washing apparatus. Moreover, in the drawings, like reference numerals designate corresponding parts throughout the several views.

DETAILED DESCRIPTION OF THE EMBODIMENTS

Figure 1:
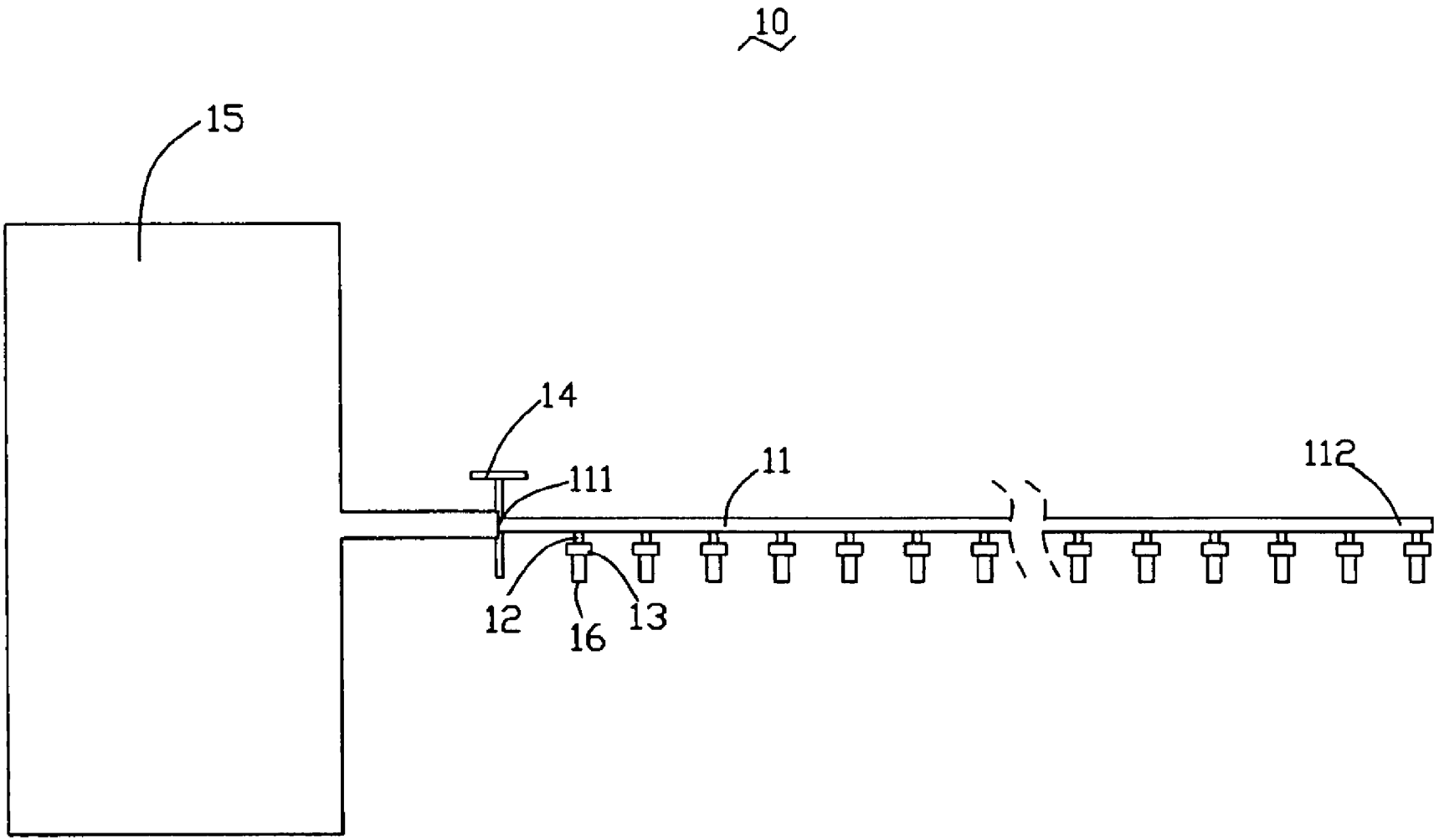
FIG. 1 is a partial schematic view of a fixture for optical elements for use in cleaning process in accordance with a preferred embodiment.

Referring to FIG. 1, in a preferred embodiment, a fixture 10 is used in cleaning process of the optical elements, such as lenses 16. The fixture 10 includes a washing bar 11, a plurality of connecting pipes 12, a plurality of holders 13, a vacuum valve 14 and a vacuum pump 15.

Figure 2:
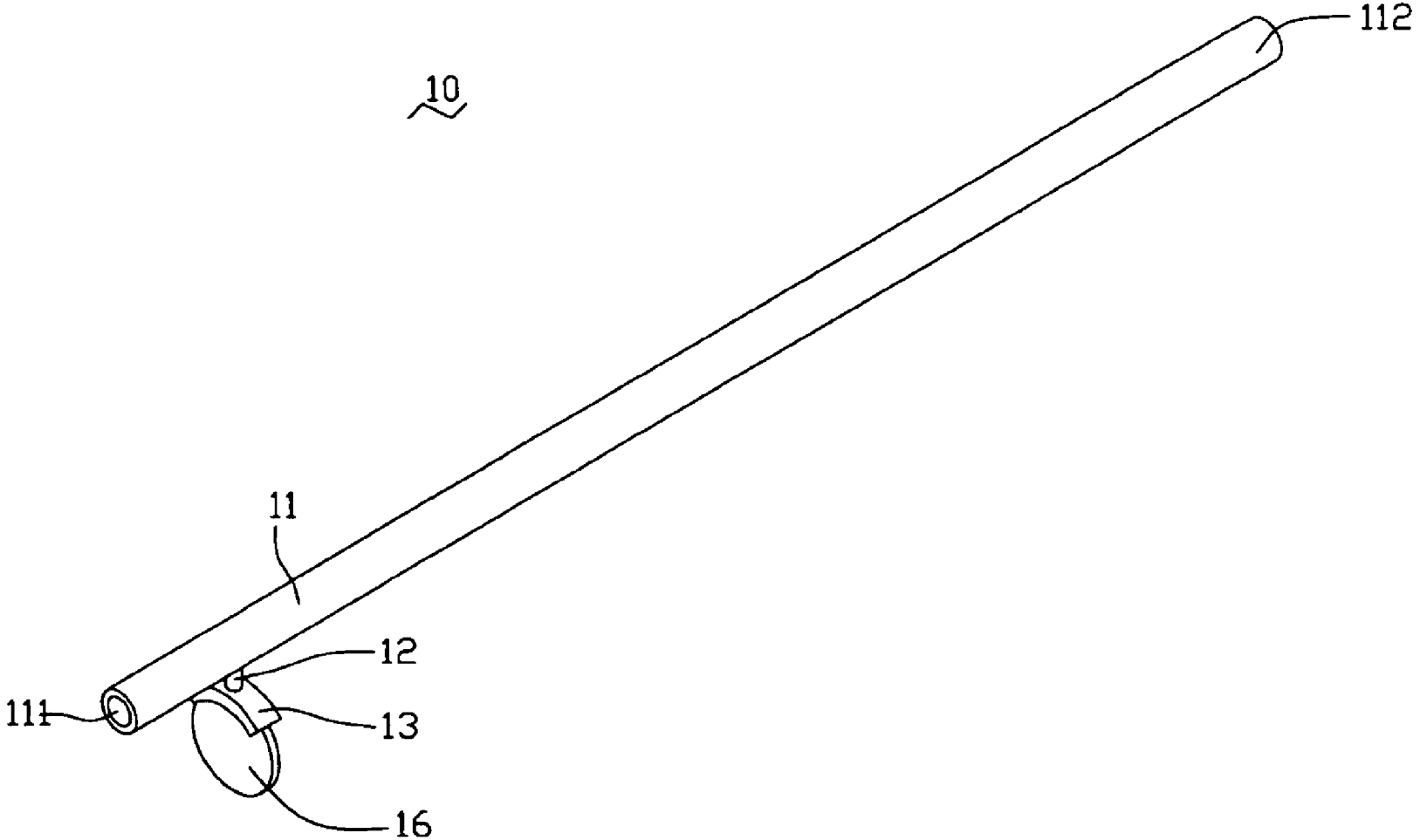
FIG. 2 is an isometric view of washing bar, connecting pipe, holder and lens shown in FIG. 1.
Figure 3:
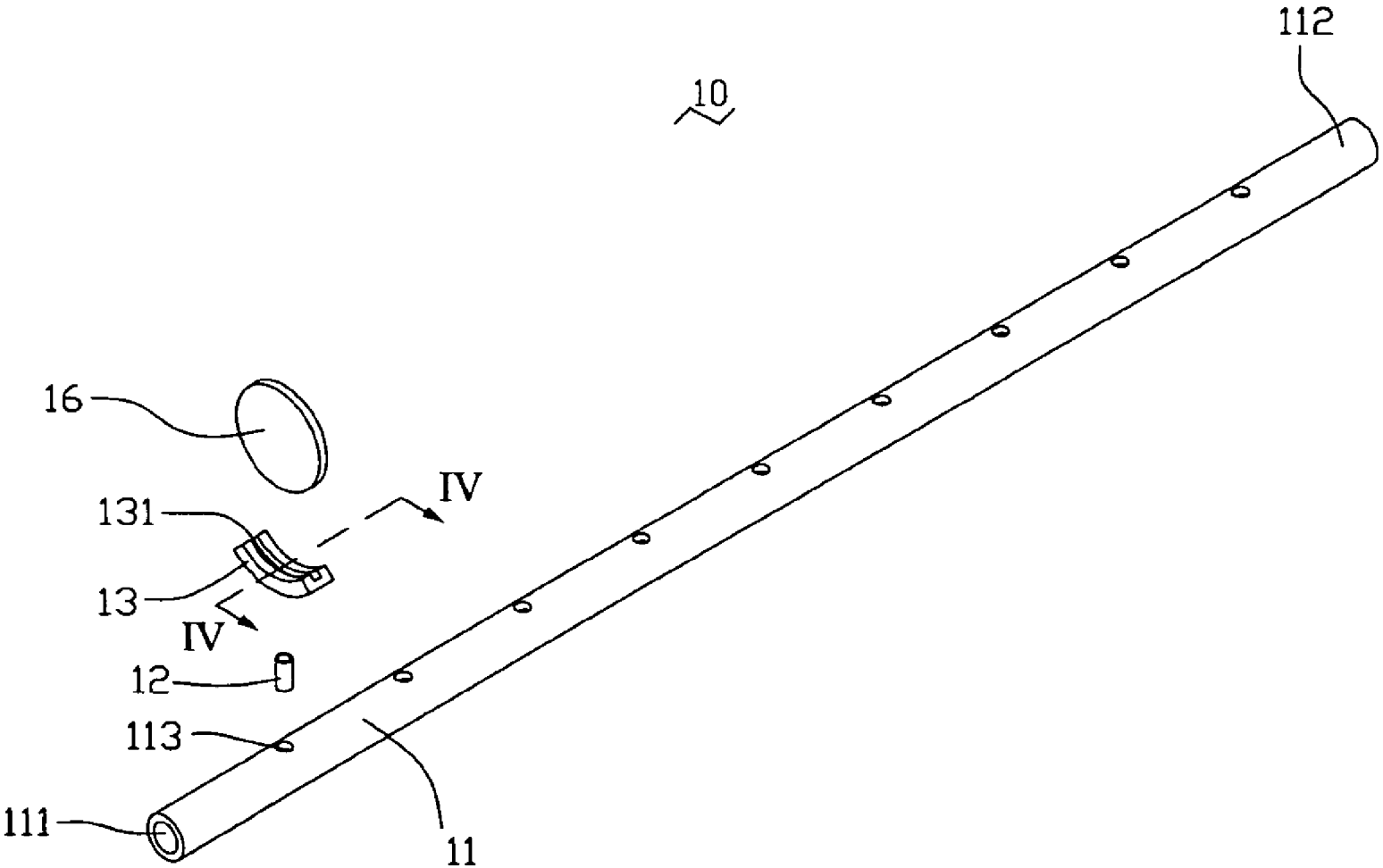
FIG. 3 is an exploded isometric view of washing bar, connecting pipe, holder and lens shown in FIG. 2.
Figure 4:
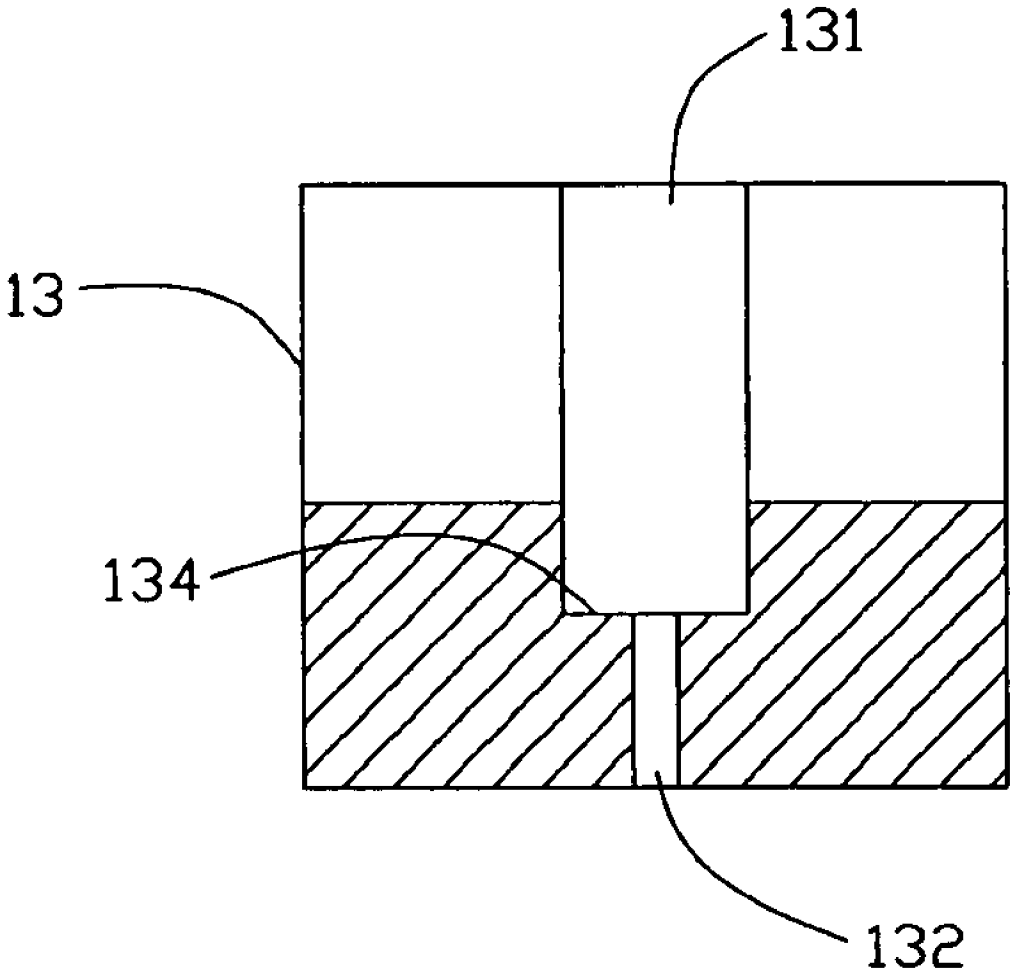
FIG. 4 is an enlarged cross-sectional view of holder taken along line IV-IV in FIG. 3.
Figure 5:
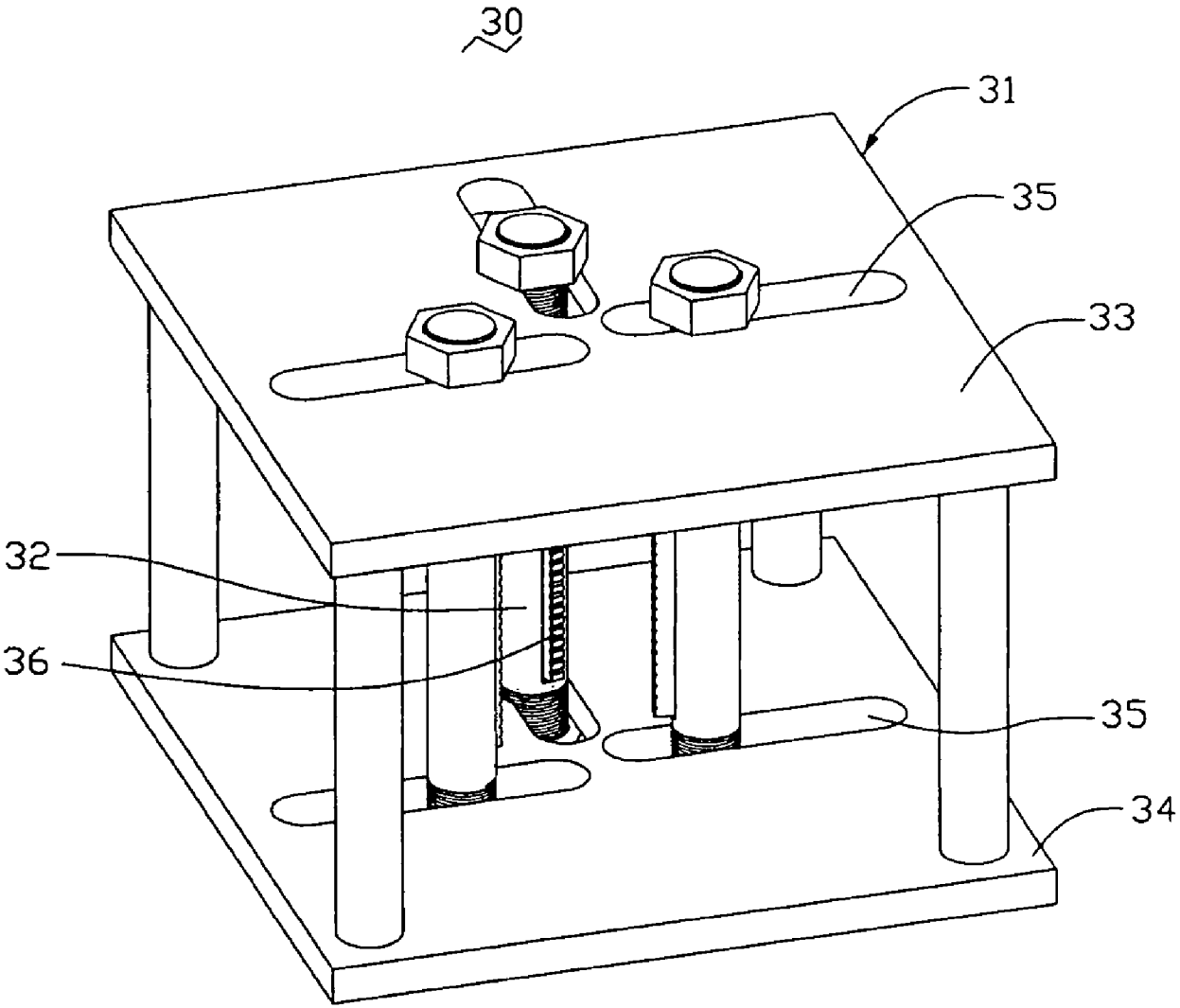
FIG. 5 is an isometric view of a conventional washing apparatus for optical elements.

Referring to FIGS. 2 and 3, the washing bar 11 is an elongated hollow pipe made of stainless steel, which includes an open end 111 and a closed end 112. The washing bar 11 has a plurality of holes 113 formed therein. These holes 113 are evenly arranged along the bar body between the open end 111 and the closed end 112.

Each of the connecting pipes 12 is a hollow pipe, which has two open ends. One open end of each connecting pipe 12 is securely connected with the washing bar 11 communicating with a corresponding one of the holes 113 thereof.

The holders 13 are fixed on the other ends of the connecting pipes 12. Each holder 13 has an arcuate groove 131, for clamping one corresponding lens. The cross section of the groove 131 is square shape. The width of groove 131 is slightly larger than the thickness of the lenses 16, and the radius of groove 131 is equal to the radius of the lenses 16. Each holder 13 has a blowhole 132 in a bottom of the groove 131. The blowholes 132 communicate with the connecting pipe 12 and the holes 113 of the washing bar 11 so as to form a gas path. As a result, the outside air can pass through the blowholes 132, the connecting pipes 12 and the holes 113 of the washing bar 11, and get inside the washing bar 11.

The vacuum valve 14 communicates the open end 111 of washing bar 11 and the vacuum pump 15. The vacuum pump 15 is used for exhausting the air inside of the washing bar 11.

In the embodiment, the washing bar 11 has an inner channel, i.e. the washing bar 11 is an elongated hollow pipe. The washing bar 11 further includes a connecting portion in communication with the inner channel, i.e. the open end 111. Each holder 13 has a holding surface 134 communicating with the hole, the holding surface 134 having a shape corresponding to a peripheral surface of the optical lenses to be held, i.e. the holding surface 134 is defined at the bottom of the groove 131.

In use, firstly, the vacuum valve 14 is opened, and the vacuum pump 15 is deflated, thus evacuating the air inside of the washing bar 11. Simultaneously, the lenses 16 are held close to the holders 13 using plastic nippers, and the part of each lens 16 is placed in the groove 131 of the holder 13 one by one. As the lenses 16 seal the blowholes 132 of the holder 13, and the vacuum pump 15 creates suction inside the washing bar 11, the lenses 16 are firmly fixed in the groove 131 of the holders 13 because of the outside pressure. Secondly, the vacuum valve 14 is closed and the vacuum pump 15 is disconnected from the vacuum valve 14. Thirdly, the fixture 10 with lenses 16 is put into the liquid to clean lenses 16. After the lenses 16 have been washed effectively, the fixture 10 is taken out of the liquid. Finally, the vacuum valve 14 is closed and the lenses 16 are removed from the fixture 10.

In an alternative embodiment, the connecting pipe 12 may not be included and the holders 13 can be fixed on the washing bar 11 directly. The vacuum valve 14 may also be omitted, because the vacuum pump 15 may be connected with the open end 111 of the washing bar 11 directly. The shape of the groove 131 may vary with the shape of the lenses to be washed. The washing bar 11 may be formed of other suitable materials, such as aluminum or iron.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A fixture for optical elements, comprising:

a washing bar, wherein the washing bar is a hollow pipe including an open end and a closed end, the washing bar has a plurality of holes formed therein, the holes communicating with the open end;

a plurality of arcuate holders connecting with the washing bar, each holder having a groove formed therein, the groove having a holding surface for receiving a corresponding optical element and a blowhole defined in a bottom of each groove, the holding surface having a shape corresponding to one portion of peripheral edge of the optical element, to be held in the groove, the blowholes communicating with the holes of the washing bar; and a suction-creating equipment connecting with the open end of the washing bar for fixing the optical element.

2. The fixture for optical elements as claimed in claim 1, further including a plurality of connecting pipes, the connecting pipes perpendicularly connecting with the washing bar and holders.

3. The fixture for optical elements as claimed in claim 1, further including a vacuum valve connecting with the open end of the washing bar, the suction-creating equipment connecting with the vacuum valve.

4. The fixture for optical elements as claimed in claim 1, wherein the material of the washing bar is stainless steel, and the open end and the closed end are coaxial.

5. The fixture for optical elements as claimed in claim 1, wherein the width of each groove is larger than the thickness of the optical element to be held in the groove.

6. The fixture for optical elements as claimed in claim 1, wherein the cross section of each groove is square.

7. The fixture for optical elements as claimed in claim 1, wherein the grooves are arcuate.

8. The fixture for optical elements as claimed in claim 7, wherein each groove has a radius equal to a radius of the optical element to be held in the groove.

* * * * *